US008287396B1

(12) United States Patent
Levy

(10) Patent No.: US 8,287,396 B1
(45) Date of Patent: Oct. 16, 2012

(54) GOLF SWING TRAINING DEVICE

(76) Inventor: Bernard Levy, Houston, TX (US)

( * ) Notice: Subject to any disclaimer, the term of this patent is extended or adjusted under 35 U.S.C. 154(b) by 0 days.

(21) Appl. No.: 13/434,140

(22) Filed: Mar. 29, 2012

(51) Int. Cl.
*A63B 69/36* (2006.01)

(52) U.S. Cl. ..... 473/262; 473/257

(58) Field of Classification Search ..... 473/159, 473/218, 219, 257, 261, 264, 265, 266, 270, 473/278
See application file for complete search history.

(56) References Cited

U.S. PATENT DOCUMENTS

| | | | | |
|---|---|---|---|---|
| 3,301,561 | A | 1/1967 | Kaiser | |
| 3,375,010 | A | 3/1968 | Panza | |
| 3,857,570 | A | 12/1974 | Gutierrez et al. | |
| 3,942,802 | A | 3/1976 | Wright | |
| 4,082,287 | A | 4/1978 | Berkey | |
| 5,503,395 | A | 4/1996 | Cook | |
| 5,839,971 | A | 11/1998 | Downing | |
| 5,904,625 | A | 5/1999 | Shillingburg | |
| 6,048,273 | A | 4/2000 | Clement | |
| 6,129,639 | A * | 10/2000 | Brock et al. | 473/260 |
| 6,443,852 | B1 * | 9/2002 | Kim | 473/265 |
| 6,458,041 | B1 | 10/2002 | Brandt | |
| 7,004,851 | B2 * | 2/2006 | Pierce | 473/261 |
| 7,112,146 | B2 | 9/2006 | Bennett | |
| 7,597,632 | B2 | 10/2009 | Edwards et al. | |
| D606,613 | S * | 12/2009 | Prestwich | D21/791 |
| 2004/0038743 | A1 | 2/2004 | Belanger | |
| 2005/0181885 | A1 | 8/2005 | Yamanaka | |
| 2005/0272518 | A1 | 12/2005 | Bennett | |

* cited by examiner

*Primary Examiner* — Nini Legesse
(74) *Attorney, Agent, or Firm* — Mossman Kumar & Tyler PC

(57) ABSTRACT

A golf swing training device has a base with a top side and a bottom side, where at least one ground anchor extends from the base away from the bottom side to engage the ground. The base also has at least one substantially horizontal indicator rod on the top side thereof, where the rod has a proximal end fixed to the base and a distal end extending from the base, where the rod has transverse sides, where the rod is configured to vibrate in a generally horizontal plane. The golf swing training device additionally has at least one bumper on the base on either side of the substantially horizontal indicator rod, where the horizontal indicator rod is configured to vibrate or move between the bumpers in a transverse horizontal direction where range of horizontal direction is limited by the bumpers.

20 Claims, 2 Drawing Sheets

GOLF SWING TRAINING DEVICE

TECHNICAL FIELD

The present invention relates to apparatus and methods to train golfers how to drive a golf ball, and more particularly relates, in one non-limiting embodiment, to portable apparatus and methods to train golfers how to drive a golf ball by getting under the ball.

TECHNICAL BACKGROUND

One of the most serious faults of golfers, particularly beginners, is their failure to keep the head of the club low during the forward swing. Ideally, the head of the club should strike the ball while instantaneously traveling in a horizontal plane. Striking the ball too high with the club head is often referred to as "topping" the ball. It is necessary for the club head to get under the ball sufficiently to lift the ball into the air for a successful drive. Topping the ball typically results in a significantly shorter and unsatisfactory distance that the ball is driven.

Further, in many cases, the inexperienced golfer will shorten the arc through which the head passes due to improper wrist action. That is, the inexperienced golfer will ordinarily "break" his or her wrists too soon in the backward stroke; whereas a delayed wrist action is desired where the wrists break just before impact with the ball.

Another fault of the inexperienced golfer is the failure to keep his or her head down. The normal tendency of any beginner is to lift his or her head too soon, in which case the proper swing cannot be executed. When the golfer lifts his or her head at the time of impact, topping will occur. The golfer would have to speculate or wonder if there was upper movement of his or her head that prevented the optimal trajectory. Finally, many inexperienced golfers have difficulty in aiming their shot.

It would be desirable if a new, portable training device were available to help novice golfers improve their golf swings, particularly to train them to get under the ball by an appropriate amount.

SUMMARY

There is provided in one non-limiting embodiment a golf swing training device that has a base having a top side and a bottom side, and at least one ground anchor extending from the base away from the bottom side. The golf swing training device further has at least one substantially horizontal indicator rod on the top side having a proximal end fixed to the base and a distal end extending over the base, the rod having transverse sides. Finally, the golf swing training device has at least one bumper on the base on either side of the substantially horizontal indicator rod, where the horizontal indicator rod is configured to vibrate or move side-to-side between the bumpers in a transverse horizontal direction where range of horizontal direction is limited by the bumpers.

There is additionally provided in one non-restrictive version, a method of a golfer learning to drive a golf ball using the above-described golf swing training device. The method includes placing a golf ball beneath the distal end of the substantially horizontal indicator rod and the golfer facing the golf swing training device so that when the golfer addresses the golf ball with a golf club the proximal end of the substantially horizontal indicator rod is away from the golfer. The method further includes the golfer driving the golf ball with a swing so that when the golf club strikes the substantially horizontal indicator rod causing it to move in a transverse horizontal direction (vibrates), the vibrating rod indicates the swing was too high; or when the substantially horizontal indicator rod remains stationary, the rod indicates the swing was correct.

It will be appreciated that the drawings are not necessarily to scale and that certain features may be exaggerated out of proportion for clarity.

DETAILED DESCRIPTION

It has been surprisingly discovered that a golf swing training device having a substantially horizontal indicator rod pointing at the golfer during training can help improve a golfer's swing when driving the ball. This is surprising because in many cases previous golf swing training devices have a wire, rod or guide oriented perpendicular to this direction, that is, oriented along the hoped-for path of the ball.

The golf swing training device herein is designed or adapted to help a golfer learn to get under a ball when driving it from a tee or from the ground. Stated another way, the device is configured to train the golfer not to "top" the ball—that is hit the ball with the club head too high on the ball which can reduce or greatly shorten the distance that the ball is driven. The golf swing training device will help the golfer think about whether his or her head, torso, arms, wrists and/or hands moved upwardly just prior to or at the time of impact that prevented optimal trajectory. The device will thus provide immediate feedback that there was one or more of these upward movements. The golf swing training device is portable, and as will be described in more detail, may be used directly on the ground or with a portion of artificial turf. Additionally, because the device, when used properly, involves the golfer looking at the distal end of the horizontal indicator rod, the device further encourages the golfer to keep his or her head down.

One feature of the device is that after a practice swing that is too high the device automatically re-sets without the golfer having to manually re-set the device. Thus, the golfer can make any number of practice swings with real or practice golf balls (e.g. those which are plastic, foam, "whiffle" type, etc.) without having to bend down to re-set the device for another swing. The substantially horizontal indicator rod is also vertically adjustable to accommodate whether the ball is on the ground or on a tee, and/or whether or not the artificial turf embodiment is employed.

While the golf swing training device described herein may be used to help improve a golfer's swing when driving the ball, such as for a tee shot, or from a ground lie, the device may also be used to help a golfer improve their putting if topping the ball is a problem when putting.

Figure 1:
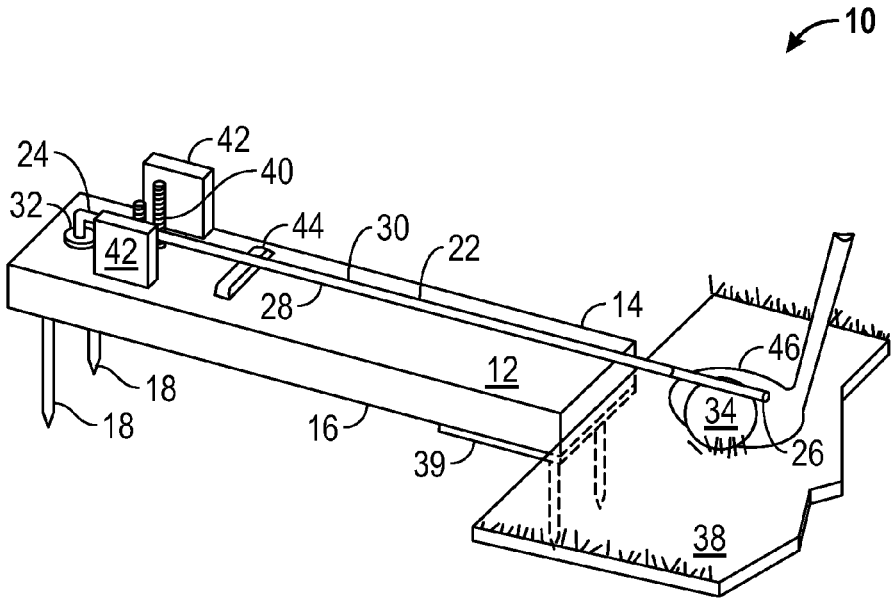
FIG. 1 is a three-quarters perspective view of the golf swing training device where a golf ball is placed beneath the distal end of the substantially horizontal indicator rod where a club head is addressing the ball.

Shown in FIG. 1 is a golf swing training device 10 in three-quarters or perspective view showing a base 12 which may be generally rigid, which base 12 has a top side 14 and a bottom side 16. By "generally rigid" is meant the base 12 is not malleable or bendable. In non-limiting examples, the base may be made of wood, metal, rigid plastic or similar materials. The base 12 should be sufficiently durable in case it is accidentally struck by a golf club, or accidentally or intentionally stepped on. For instance, as will be described, one method of anchoring the device 10 into the ground is to step on it. The base 12 should also be sufficiently durable so that it is not adversely affected by being wet or subjected to hot and cold environments and weather in which the average golfer would want to use it. The base 12 as shown in the Figures is elongated, although it does not have to have this shape. Base 12 should have a generally flat bottom side 16 or other bottom side 16 configuration or design so that it rests flat and stable on the ground 20. However, as viewed from the top (as in FIG. 3), base 12 may be square, triangular, circular, oval, or any number of suitable shapes.

Figure 4:
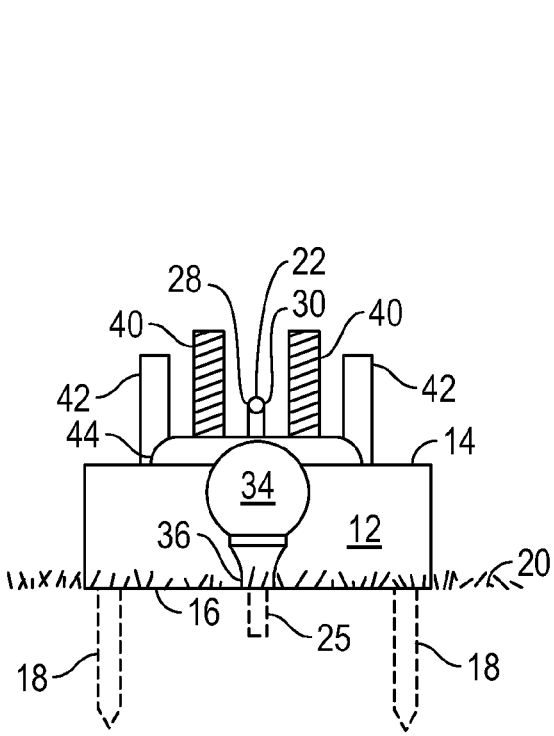
FIG. 4 is an end view of the golf swing training device of FIG. 1.

Golf swing training device 10 also has at least one ground anchor 18 extending from the base away from the bottom side 16 of the base 12 to secure the golf swing training device 10 to the ground 20 (see also FIGS. 1 and 4). The anchor may take the form of a plurality of spikes 18. In the non-limiting embodiment shown in the Figures, there are four spikes 18 serving as anchors (in a non-limiting example, 6-inch nails), although many other configurations of anchors 18 may be envisioned. In the non-limiting configuration shown in the Figures, device 10 may be anchored to the ground 20 by pressing the anchors 18 into the ground by pushing on the base 12 with hands or feet. In non-limiting examples, instead of four spikes 18 there could be a different number and the spikes could variously be angled instead of perpendicular to the bottom 16 of the base as shown in the Figures. Instead of the spikes 18 being fixed in place on base 12, the anchors could be inserted through holes (not shown) in the base 12. Alternatively, the anchor or anchors may be corkscrew-shaped, permanently or non-permanently fixed in base 12, but adapted to rotate through a hole in the base 12 to engage the ground. Regardless of the various embodiments of suitable anchors 18, the anchors 18 should be adapted to temporarily fix the golf swing training device 10 to the ground 20.

In the case of anchors 18 being in the form of fixed spikes or nails, it would be advisable to provide protective guards (not shown), such as fabric covers or foam blocks (e.g. polystyrene) or cork cylinders to prevent accidental injury or damage to persons or property during handling of the golf swing training device 10. Alternatively, the anchors 18 at their point of attachment to the bottom side 16 of base 12 may be rotatable, such as rotatable 90° into a clip or recess (not shown) on the bottom side 16 of base 12.

Figure 2:
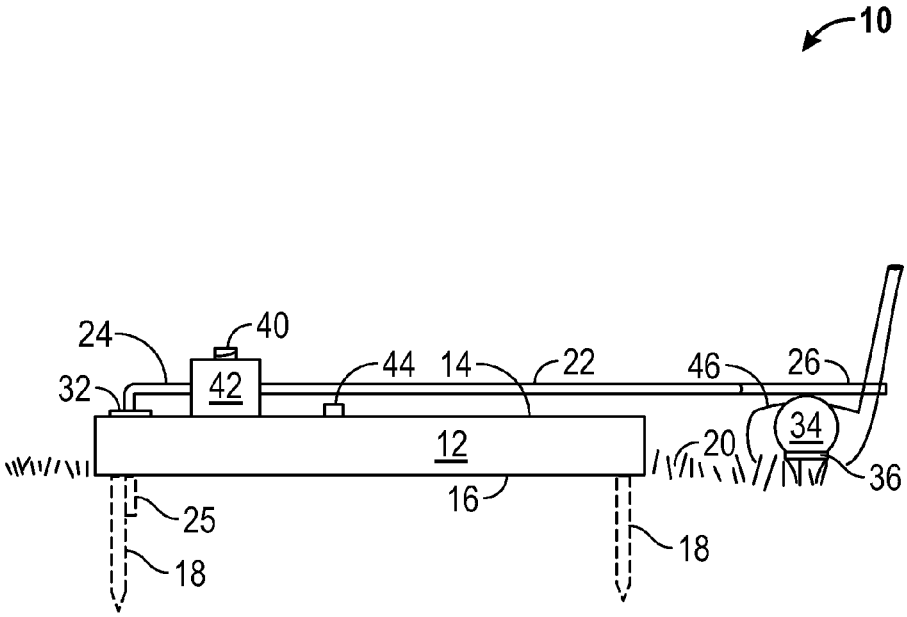
FIG. 2 is a side view of the golf swing training device of FIG. 1.

The golf swing training device 10 also includes at least one substantially horizontal indicator rod 22 on the top side 14 having a proximal end 24 fixed to the base 12 and a distal end 26, the rod 22 having transverse sides 28, 30. The distal end 26 extends from the base 12 and optionally extends over the elongated base 12 as shown in the Figures, particularly FIG. 2. It is not necessary for rod 22 to be precisely or exactly horizontal for it to function as intended and described herein. It will be appreciated that since rod 22 is anchored or attached only at the pivot point 32, the distal end 26 will sag or droop slightly due to gravity. This is acceptable. It is expected that the indicator rod 22 may be at a decline of up to 5°, even up to 10° from horizontal and still function for its stated purpose.

The substantially horizontal indicator rod 22 may be suitably formed of one or a combination of a variety of materials including, but not necessarily limited to, metal (e.g. wire), wood, plastic, elastomeric polymer, bamboo, and the like.

The proximal end 24 of rod 22 is secured to the base 12 at pivot point 32. In one non-limiting embodiment, the pivot point 32 is configured so that the proximal end 24 of the substantially horizontal indicator rod 22 (and thus all of the rod 22) is vertically adjustable with respect to the base. This is to accommodate various heights of a golf ball 34, whether or not it is lying directly on the ground 20, or on a tee 36 or on an artificial turf segment 38. The vertical adjustment of the proximal end 24 of the substantially horizontal indicator rod 22 may be accomplished in a variety of ways including, but not necessarily limited to proximal end 24 being bent 90° or at a right angle to the rest of the substantially horizontal indicator rod 22, in a non-limiting embodiment as leg 25 shown in FIGS. 2 and 4, and inserted into a tight-fitting grommet made of, in non-limiting examples, rubber, elastomeric polymer, plastic, metal, cork, or the like. In one non-restrictive version, the bent leg 25 may extend through the base 12 and penetrate the ground 20, e.g. for about an inch, when completely lowered. This configuration allows the golfer to adjust the height of the rod 22 to accommodate the placement of the ball 34, i.e. on the ground 20 or on a tee 36.

Alternatively or additionally, the bent leg 25 of proximal end 24 may be held in place with a set screw, bolt, rod or the like (not shown). In another, alternate version, the proximal end 24 may be configured to telescope in and out of the base 12, similarly to a telescoping leg on a camera tripod or conventional car antenna. In a different non-limiting embodiment the proximal end 24 may be straight, but inserted into a structure such as an armature or post (not shown) having a variety of holes at various heights into which the proximal end 24 of rod 22 may be inserted. In another non-limiting version, the height of the armature or post may be additionally or alternatively adjustable by height or vertical position relative to base 12. The armature or post may be vertically adjustable by any acceptable mechanism including, but not necessarily limited to, a tight-fitting grommet; adjustable set screw, bolt or rod; telescoping sleeves and the like, etc.

Figure 3:
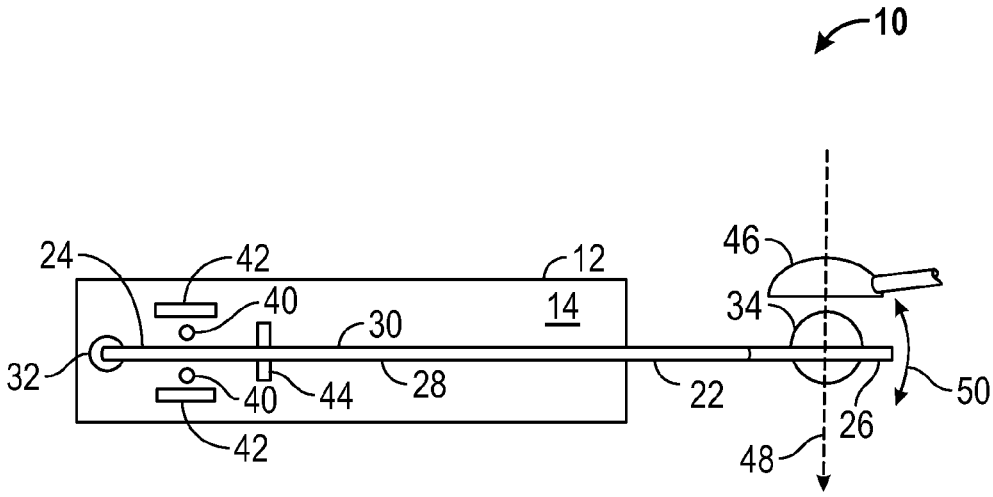
FIG. 3 is a top view of the golf swing training device of FIG. 1.

The golf swing training device 10 also has at least one bumper 40 on either side of the substantially horizontal indicator rod 22 (also see FIGS. 3 and 4), where the horizontal indicator rod 22 is configured to move between the bumpers 40 in a transverse horizontal direction, for example vibrate side-to-side, as shown by double-headed arrow 50 of FIG. 3, where the range of horizontal direction is limited by the bumpers 40. Bumpers 40 are illustrated in the Figures as vertical springs, in a non-limiting instance as coiled metal springs, but they may have other configurations including, but not necessarily limited to, polymeric elastomers (e.g. cellular or non-cellular polyurethane, polyisoprene, polybutadiene, polychloroprene, butyl rubber, styrene-butadiene rubber (SBR), nitrile rubber, and the like), metal leaf springs, and combinations thereof, and may be any resilient material and/or a spring. A spring includes any spring-like structure or material that bounces back. "Resilient" is defined herein as bouncing or springing back into shape or position after being hit, bent, stretched or otherwise impacted. An elastomer is defined as any natural or artificial material (e.g. synthetic polymer) that has properties similar to vulcanized natural rubber.

Further, while bumpers 40 are shown near (that is proximal) the proximal end 24 of the substantially horizontal indicator rod 22, bumpers 40 may be located at different places along the length of rod 22 on base 12 so long as they accomplish the stated purpose. Indeed, it is acceptable for there to be multiple pairs of bumpers 40 along the length of rod 22.

With the configuration or design described above, if the distal end 26 of the substantially horizontal indicator rod 22 is struck or hit on either transverse side 28 or 30, the rod 22 vibrates or swings from side-to-side in the direction of double-headed arrow 50 of FIG. 3 in a generally horizontal plane where the range of horizontal direction is limited by the bumpers 40. It is not necessary that this plane of vibration be exactly or precisely horizontal for the device 10 to operate for its stated function.

In another non-limiting embodiment, the distal end 26 of the substantially horizontal indicator rod 22 may be of a different and/or contrasting color than the rest of (or balance of) rod 22. This different color would help the golfer focus more closely on ball 34 when viewed from above. As shown more clearly in FIGS. 3 and 4, a golf ball 34 expected to be centered at least approximately directly below distal end 26.

The golf swing training device 10 may also optionally be supplied with a detachable artificial turf segment 38, for instance a swatch of artificial turf that is physically placed under the distal end 26 of rod 22, which may be temporary or permanently affixed to base 12 by any number of techniques including, but not necessarily limited to a panel 39 having holes (not shown) through which anchors 18 pass to engage the ground 20, but additionally or alternatively, screws, bolts, brads, snaps, buttons, hook-and-loop fasteners (e.g. VELCRO® fabric fastener), and the like.

In a different non-restrictive version of the golf swing training device 10, the device 10 may be provided with at least one rigid stop or backboard 42, anchored in or connected to the base 12, proximate to the bumper 40 on a side of each bumper 40 opposite the substantially horizontal indicator rod 22. As shown in the Figures, rigid stops 42 may be vertically oriented and rectilinear or square-shaped, but they may be any shape or orientation so long as they can fulfill their function of "back stopping" or backing up bumpers 40. In one embodiment rigid stops 42 function in case bumpers 40 fail. In another non-restrictive version, rigid stops 42 may help facilitate the vibration or side-to-side movement of the rod 22 when distal end 26 is struck or hit. Alternatively, stops 42 serve to prevent overextension of springs or bumpers 40. Stops 42 may be made of any suitable rigid material including, but not necessarily limited to, metal (e.g. iron or steel), wood, plastic, or the like.

The bumpers 40, with or without rigid stops 42, help to substantially center rod 22 automatically between bumpers 40 in position on the base 12 should the rod 22 be struck or hit when in use.

Another optional feature is elevated hump 44 on the top side 14 of base 12 beneath the substantially horizontal indicator rod 22 to prevent rod 22 from dragging on base 12. Although the hump 44 is shown as a small horizontal ridge or strip rounded on either end in the center of the base 12, it may have any number of other possible configurations including, but not necessarily limited to, semicircular, dome-like, block-like or other convex shape. Hump 44 may also be made of any suitable, durable material to hold off rod 22 from base 12, including, but not necessarily limited to, metal (e.g. iron or steel), wood, plastic, rubber, rigid or elastomeric polymer, and the like. The hump 44 may be, but does not have to be, centered on the top side 14 of base 12 so long as it prevents or inhibits rod 22 from dragging on base 12.

In operation, the golfer places a golf ball 34 (or suitable practice ball) beneath the distal end 26 of the substantially horizontal indicator rod 22, on either the ground 20 or artificial turf segment 38. The substantially horizontal indicator rod 22 should be vertically adjusted to be above the ball 34, that is, not touching the ball 34. The distance that the distal end 26 is above ball 34 may range from about 1/16 inch independently to about 6 inches, alternatively from about ½ inch independently to about 4 inches, and in another non-limiting embodiment from about 1 inch to about 3 inches, where "independently" means that any lower threshold may be paired with any upper threshold to give a suitable alternative range. The golfer may begin practice with the distal end 26 relatively high and then lower it as his or her swing improves.

As the golfer views the ball 34, it is directly beneath distal end 26, for instance see FIG. 3 as viewed from the right side of FIG. 3, where, for a right-handed golfer the golf club head 46 is to the right of the ball 34. In other words, the golfer facing the golf swing training device 10 so that when the golfer addresses the golf ball 34 with a golf club the proximal end 24 of the substantially horizontal indicator rod 22 is away from the golfer, and the device 10 is generally oriented perpendicular to the path of swing 48. When the golfer swings and hits the ball, when the golf club head 46 strikes the substantially horizontal indicator rod 22 causing it to move back-and-forth in a transverse horizontal direction (or vibrate), the rod 22 thus indicates the swing was too high, and the golfer needs to adjust his or her swing downward. Alternatively, when the substantially horizontal indicator rod 22 remains stationary, the rod 22 indicates the swing was correct. In this iterative manner, the golfer will learn to hit the ball from underneath, thereby avoiding topping the ball. Since the rod 22 in device 10 is self-adjusting and re-sets or re-centers, the golfer does not have to manually readjust or re-set the rod 22 after each time it is hit, and the golfer may hit any number of balls 34 for practice at getting under the ball 34.

In the foregoing specification, the invention has been described with reference to specific embodiments thereof, and has been demonstrated as effective in providing methods and apparatus for learning how to drive a golf ball by properly getting under the ball and not topping it. However, it will be evident that various modifications and changes can be made thereto without departing from the broader spirit or scope of the invention as set forth in the appended claims. Accordingly, the specification is to be regarded in an illustrative rather than a restrictive sense. For example, specific bases, anchors, indicator rods, bumpers, stops, humps, turf segments falling within the claimed parameters, but not specifically identified or exemplified in a particular apparatus or method, are expected to be within the scope of this invention.

The words "comprising" and "comprises" as used throughout the claims is interpreted "including but not limited to".

The present invention may suitably comprise, consist or consist essentially of the elements disclosed and may be practiced in the absence of an element not disclosed. For instance, a golf swing training device may consist of or consist essentially of a base having a top side and a bottom side; at least one ground anchor extending from the base away from the bottom side; at least one substantially horizontal indicator rod on the top side having a proximal end fixed to the base and a distal end, the rod having transverse sides; and at least one bumper on the base on either side of the substantially horizontal indicator rod, where the horizontal indicator rod is configured to move between the bumpers in a transverse horizontal direction where range of horizontal direction is limited by the bumpers, as these elements are defined in the claims.

What is claimed is:

1. A golf swing training device comprising:

a base having a top side and a bottom side;

at least one ground anchor extending from the base away from the bottom side;

at least one substantially horizontal indicator rod on the top side having a proximal end fixed to the base and a distal end, the rod having transverse sides; and at least one bumper on the base on either side of the substantially horizontal indicator rod, where the horizontal indicator rod is configured to move between the bumpers in a transverse horizontal direction where range of horizontal direction is limited by the bumpers.

2. The golf swing training device of claim 1 where the bumpers are selected from the group consisting of resilient material, springs, and combinations thereof.

3. The golf swing training device of claim 1 where the distal end of the horizontal indicator rod is a different color than the balance of the horizontal indicator rod.

4. The golf swing training device of claim 1 where the proximal end of the substantially horizontal indicator rod fixed to the base is vertically adjustable.

5. The golf swing training device of claim 1 further comprising detachable artificial turf beneath the distal end of the horizontal indicator rod.

6. The golf swing training device of claim 1 further comprising at least one rigid stop proximate to the bumper on a side of each bumper opposite the substantially horizontal indicator rod.

7. The golf swing training device of claim 1 where the base is substantially rigid.

8. The golf swing training device of claim 1 where the at least one bumper on either side of the substantially horizontal indicator rod is on a side of the proximal end of the substantially horizontal indicator rod, proximal to the proximal end.

9. The golf swing training device of claim 1 where the top side of the base bears a hump beneath the substantially horizontal indicator rod.

10. A golf swing training device comprising:

a substantially rigid base having a top side and a bottom side;

at least one ground anchor extending from the base away from the bottom side;

at least one substantially horizontal indicator rod on the top side having a proximal end fixed to the base and a distal end extending over the base, the rod having transverse sides, the rod configured to vibrate in a generally horizontal plane, where the proximal end of the substantially horizontal indicator rod fixed to the base is vertically adjustable; and at least one bumper on either side of the substantially horizontal indicator rod, where the horizontal indicator rod is configured to move between the bumpers in a transverse horizontal direction where range of horizontal direction is limited by the bumpers.

11. The golf swing training device of claim 10 where the bumpers are selected from the group consisting of resilient material, springs, and combinations thereof.

12. The golf swing training device of claim 10 where the distal end of the horizontal indicator rod is a different color than the balance of the horizontal indicator rod.

13. The golf swing training device of claim 10 further comprising detachable artificial turf beneath the distal end of the horizontal indicator rod.

14. The golf swing training device of claim 10 further comprising at least one rigid stop proximate to the bumper on a side of each bumper opposite the substantially horizontal indicator rod.

15. The golf swing training device of claim 10 where the at least one bumper on either side of the substantially horizontal indicator rod is on a side of the proximal end of the substantially horizontal indicator rod, proximal to the proximal end.

16. A method of a golfer learning to drive a golf ball comprising:

in the presence of a golf swing training device comprising:

a base having a top side and a bottom side;

at least one ground anchor extending from the base away from the bottom side;

at least one substantially horizontal indicator rod on the top side having a proximal end fixed to the base and a distal end, the rod having transverse sides, the rod configured to vibrate in a generally horizontal plane;

at least one bumper on the base on either side of the substantially horizontal indicator rod, where the horizontal indicator rod is configured to move between the bumpers in a transverse horizontal direction where range of horizontal direction is limited by the bumpers;

the method comprising:

placing a golf ball beneath the distal end of the substantially horizontal indicator rod;

the golfer facing the golf swing training device so that when the golfer addresses the golf ball with a golf club the proximal end of the substantially horizontal indicator rod is away from the golfer; and the golfer driving the golf ball with a swing where:

when the golf club strikes the substantially horizontal indicator rod causing it to move in a transverse horizontal direction, the rod indicates the swing was too high; or when the substantially horizontal indicator rod remains stationary, the rod indicates the swing was correct.

17. The golf swing training device of claim 16 where the bumpers are selected from the group consisting of resilient material, springs, and combinations thereof.

18. The golf swing training device of claim 16 where the proximal end of the substantially horizontal indicator rod fixed to the base is vertically adjustable.

19. The golf swing training device of claim 16 further comprising at least one rigid stop proximate to the bumper on a side of each bumper opposite the substantially horizontal indicator rod.

20. The golf swing training device of claim 16 where the at least one bumper on either side of the substantially horizontal indicator rod is on a side of the proximal end of the substantially horizontal indicator rod, proximal to the proximal end.

* * * * *